US005554116A

United States Patent [19]

Fu-Hsiang

[11] Patent Number: 5,554,116

[45] Date of Patent: Sep. 10, 1996

[54] DEVICE FOR ORAL DISPENSING OF MEDICINE

[76] Inventor: Chen Fu-Hsiang, 47-14, Fan-po Street, Fan-po Village, Fu-Hsin Hsiang, Chang Hwa Hsien, Taiwan

[21] Appl. No.: 555,858

[22] Filed: Nov. 13, 1995

[51] Int. Cl.[6] ..... A61J 17/00

[52] U.S. Cl. ..... 604/77; 606/236

[58] Field of Search ..... 604/77, 73, 56, 604/208, 210; 606/234, 235, 236

[56] References Cited

U.S. PATENT DOCUMENTS 5,383,906 1/1995 Burchett et al. ..... 606/236

5,431,680 7/1995 Jones ..... 604/77 X 5,487,750 1/1996 Burchett et al. ..... 606/236

*Primary Examiner*—John D. Yasko

*Attorney, Agent, or Firm*—Larson And Taylor

[57] ABSTRACT

An oral dispensing device includes a bottle for receiving medicine. A post is extended from the bottle and has a number of fins for forming a number of liquid passages. A nipple is engaged on the post and is secured to the bottle by a cover. A plunger is slidably engaged in the bottle for forcing the medicine outward through the orifice and the liquid passages and through the hole of the nipple in order to inject the medicine into the mouths of the babies. The medicine may also be effectively forced through the liquid passages when the nipple is bitten by babies.

2 Claims, 2 Drawing Sheets

DEVICE FOR ORAL DISPENSING OF MEDICINE

BACKGROUND OF THE INVENTION

1. Field of the Invention

The present invention relates to a dispensing device, and more particularly to a device for oral dispensing of medicine.

2. Description of the Prior Art

A close related U.S. patent application filed by the applicant is allocated with a Ser. No. 08/381,302, now U.S. Pat. No. 5,478,325, entitled "SOLUTION FEEDER WITH A NIPPLE", and is taken as a reference of the present invention. The feeder includes a bottle having a nipple for engaging with the mouths of the babies. However, the bottle may not be effectively pressed or pumped for pumping the solution accommodated in the bottle into the mouths of the babies.

The present invention has arisen to mitigate and/or obviate the afore-described disadvantages of the conventional dispensing devices.

SUMMARY OF THE INVENTION

The primary objective of the present invention is to provide an oral dispensing device which may be used for effectively injecting medicine into the mouths of the babies.

In accordance with one aspect of the invention, there is provided an oral dispensing device comprising a bottle for receiving medicine therein, the bottle including a first end having an opening formed therein and including an annular flange extended radially outward from the first end thereof and including a second end having an orifice formed therein for allowing the medicine to be forced out of the bottle, the bottle including a post extended from the second end thereof and having a plurality of fins extended radially outward therefrom so as to define a plurality of liquid passages therebetween, a nipple engaged on the post and engaged on the second end of the bottle and including a hole for allowing the medicine to flow out of the nipple, the nipple including an annular rib extended radially outward therefrom, a cover including an aperture for engaging with the nipple, the cover being engaged with the annular rib so as to secure the nipple to the bottle, and a plunger slidably engaged in the bottle via the opening of the bottle and including an annular flange for engaging with the first end of the bottle so as to limit an inward movement of the plunger to the bottle. The medicine accommodated in the bottle may be forced outward through the orifice and the liquid passages and through the hole of the nipple when the plunger is moved inward of the bottle, and the medicine may also be effectively forced through the liquid passages when the nipple is bitten by babies.

The bottle includes an outer peripheral portion having a scale formed thereon.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
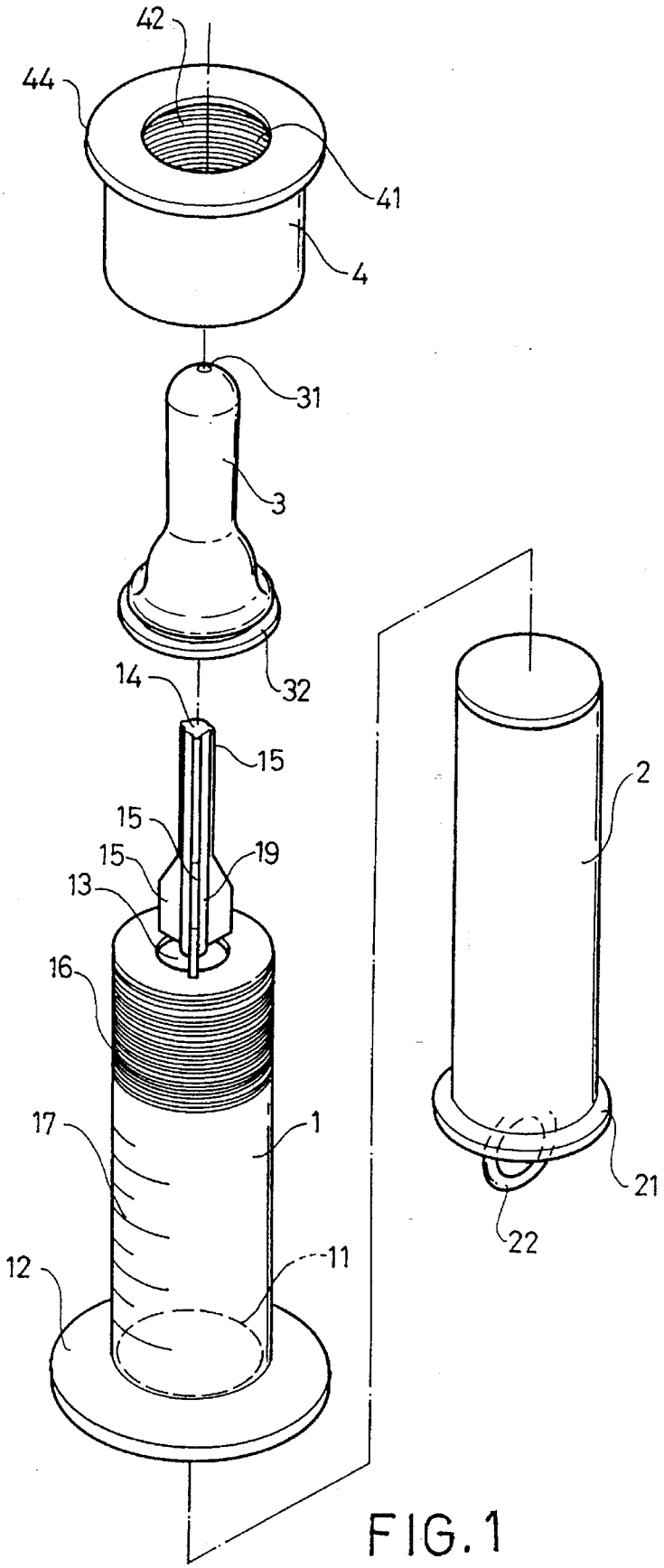
FIG. 1 is an exploded view of an oral dispensing device in accordance with the present invention.
Figure 3:
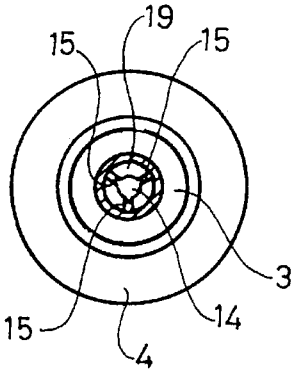
FIGS. 3 and 4 are cross sectional views taken along lines 3—3 of FIG. 2, illustrating the operation of the oral dispensing device.
Figure 2:
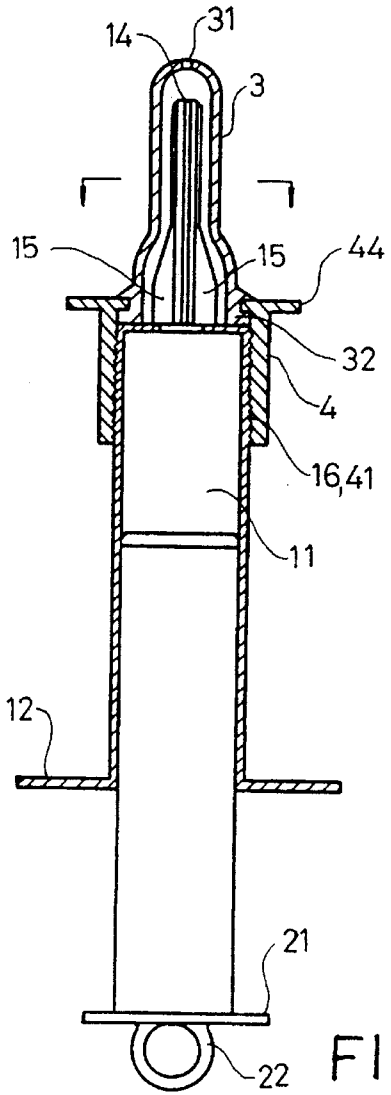
FIG. 2 is a longitudinal cross sectional view of the oral dispensing device.

Referring to the drawings, and initially to FIGS. 1 to 3, an oral dispensing device in accordance with the present invention comprises a bottle 1 which is preferably made of transparent glass or plastic materials for receiving medicine therein and which includes an open lower end 11 for engaging with a plunger 2. The bottle 1 includes an annular flange 12 extended radially outward from the lower end thereof and includes an outer thread 16 formed in the upper portion thereof for engaging with an inner thread 41 of a cover 4 and includes a scale 17 formed in the outer peripheral portion thereof. The bottle 1 includes an upper portion having an orifice 13 formed therein for allowing the medicine to be forced out of the bottle 1 by the plunger 2.

The bottle 1 further includes a post 14 extended upward from the upper end thereof and having a number of fins 15 extended radially outward therefrom so as to define a number of liquid passages 19 therebetween. A nipple 3 is engaged on the post 14 and includes a hole 31 for allowing the medicine to be injected into the mouths of the babies, and includes an annular rib 32 extended radially outward from the bottom portion thereof. The cover 4 includes an aperture 42 for engaging with the nipple 3 and the cover 4 is engaged with the annular rib 32 so as to secure the nipple 3 to the bottle 1. The cover 4 includes an annular projection 44 extended radially outward therefrom and having a size larger than the mouth of the baby so as to prevent the nipple 3 from moving further inward of the mouth of the baby. The plunger 2 includes an annular flange 21 for engaging with the annular flange 12 of the bottle 1 so as to limit the inward movement of the plunger 2 to the bottle 1. The plunger 2 includes a ring 22 for engaging with the finger of the users such that the plunger 2 may be easily moved inward and outward of the bottle 1.

Figure 4:
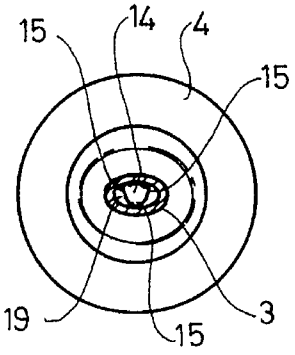

In operation, as shown in FIG. 2, the medicine accommodated in the bottle 1 may be easily forced outward of the bottle 1 and through the orifice 13 and through the liquid passages 19 and through the hole 31 of the nipple 3 by the plunger 2. As shown in FIG. 4, when the nipple 3 is bitten by the babies, the medicine may also be effectively forced through the liquid passages 19 formed between the fins 15 and will not be blocked by the deformation of the nipple 3.

Accordingly, the oral dispensing device in accordance with the present invention may be used for effectively injecting medicine into the mouths of the babies.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An oral dispensing device comprising:

a bottle for receiving medicine therein, said bottle including a first end having an opening formed therein and including an annular flange extended radially outward from said first end thereof and including a second end having an orifice formed therein for allowing the medicine to be forced out of said bottle, said bottle including a post extended from said second end thereof and having a plurality of fins extended radially outward therefrom so as to define a plurality of liquid passages therebetween, a nipple engaged on said post and engaged on said second end of said bottle and including a hole for allowing the medicine to flow out of said nipple, said nipple including an annular rib extended radially outward therefrom, a cover including an aperture for engaging with said nipple, said cover being engaged with said annular rib so as to secure said nipple to said bottle, and a plunger slidably engaged in said bottle via said opening of said bottle and including an annular flange for engaging with said first end of said bottle so as to limit an inward movement of said plunger to said bottle, the medicine accommodated in said bottle being forced outward through said orifice and said liquid passages and through said hole of said nipple when said plunger is moved inward of said bottle, and the medicine being forced through said liquid passages when said nipple is bitten by babies.

2. An oral dispensing device according to claim 1, wherein said bottle includes an outer peripheral portion having a scale formed thereon.

* * * * *